US009652958B2

(12) United States Patent
Zribi et al.

(10) Patent No.: US 9,652,958 B2
(45) Date of Patent: May 16, 2017

(54) CHAMBER-LESS SMOKE SENSOR

(71) Applicant: Carrier Corporation, Farmington, CT (US)

(72) Inventors: Anis Zribi, Colorado Springs, CO (US); Travis Silver, Colorado Springs, CO (US); Ken Fasen, Colorado Springs, CO (US); Anthony Joseph Santistevan, Colorado Springs, CO (US); Larry R. Ratzlaff, Elgin, IL (US); Valeriy Miagkov, Colorado Springs, CO (US); Stanley D. Burnette, Colorado Springs, CO (US); Vipul Patel, Sarasota, FL (US); Charles Edmund Murphy, Jr., Sarasota, FL (US)

(73) Assignee: CARRIER CORPORATION, Farmington, CT (US)

( * ) Notice: Subject to any disclaimer, the term of this patent is extended or adjusted under 35 U.S.C. 154(b) by 0 days.

(21) Appl. No.: 14/743,350

(22) Filed: Jun. 18, 2015

(65) Prior Publication Data

US 2015/0371515 A1 Dec. 24, 2015

Related U.S. Application Data

(60) Provisional application No. 62/014,408, filed on Jun. 19, 2014.

(51) Int. Cl.
*G08B 17/10* (2006.01)
*G08B 17/107* (2006.01)

(52) U.S. Cl.
CPC ..... *G08B 17/107* (2013.01)

(58) Field of Classification Search
CPC .... G08B 17/107; G08B 17/103; G08B 17/10; G01N 21/274; G01N 21/53
USPC ..... 340/630, 628; 250/339.11, 341.8, 574; 356/438, 338
See application file for complete search history.

(56) References Cited

U.S. PATENT DOCUMENTS

| | | | | |
|---|---|---|---|---|
| 3,982,130 | A * | 9/1976 | Trumble | G01N 21/534 250/373 |
| 5,477,218 | A * | 12/1995 | Manmoto | G08B 17/107 250/574 |
| 6,011,478 | A | 1/2000 | Suzuki et al. | |
| 6,515,589 | B2 | 2/2003 | Schneider et al. | |
| 6,828,913 | B2 | 12/2004 | Oppelt et al. | |
| 7,746,239 | B2 | 6/2010 | Nagashima | |
| 7,817,049 | B2 | 10/2010 | Muller et al. | |
| 7,978,087 | B2 | 7/2011 | Siber et al. | |

(Continued)

*Primary Examiner* — Toan N Pham
(74) *Attorney, Agent, or Firm* — Cantor Colburn LLP

(57) ABSTRACT

A method for detecting smoke via a chamber-less smoke sensor includes applying one or more filters to eliminate a flooding of ambient light upon the smoke sensor and emitting, by a source, light. At least one detector detects at least a portion of the emitted light and a processor processes the detected light to signal an alarm condition when one or more threshold levels are reached. A chamber-less smoke sensor includes a light source configured to emit light and at least one detector configured to detect at least a portion of the emitted light. An electronic filter and/or a processor is configured to apply one or more filters to eliminate a flooding of ambient light upon the smoke sensor and process the detected light to signal an alarm condition when a threshold level is reached.

14 Claims, 3 Drawing Sheets

(56) References Cited

U.S. PATENT DOCUMENTS

| | | | | |
|---|---|---|---|---|
| 8,085,157 | B2 * | 12/2011 | Luterotti | G01N 21/532 250/341.8 |
| 8,510,068 | B2 | 8/2013 | Kawashima | |
| 8,587,442 | B2 | 11/2013 | Loepfe et al. | |
| 8,907,802 | B2 * | 12/2014 | Erdtmann | G08B 17/107 250/573 |
| 8,941,505 | B2 * | 1/2015 | Dohi | G01N 21/53 250/573 |

* cited by examiner

CHAMBER-LESS SMOKE SENSOR

BACKGROUND

Smoke sensors, such as commercial smoke sensors, often located inside of a housing or enclosure, use near infrared light scattering inside a small plastic chamber located inside of the enclosure, with inlets of controlled dimensions to prevent entry of unwanted particles. However, some unwanted airborne particles do make their way into the chamber, causing false alarms. Over time, these particles may also collect at the inlets of the sensor chamber, making it more difficult for smoke particles to diffuse into the chamber.

A photoelectric sensor is operative on the basis of light scattering to detect particles as the particles travel through the chamber. From an efficiency perspective, detection is most efficient with particles that are at least the size of approximately one-half the wavelength of (visible) light—approximately 0.5 microns (or larger). Synthetic materials, which are increasingly being included in household items, may produce small particles that are less than 0.5 microns when burned. Such small particles may go undetected for a relatively long amount of time during a flaming fire. On the other hand, it may be difficult to distinguish the presence of large smoke particles (such as those particles that may be produced during a smoldering fire) from other objects or airborne particles. For example, it can be difficult to distinguish large particles resulting from a fire from steam or dust. Still further, it can be difficult to distinguish a fire from nuisance scenarios (e.g., cooking scenarios, such as operating a toaster, pouring alcohol into a boiling pot, etc.).

Eliminating the chamber would increase the exposure of a sensing element (e.g., photoelectric sensor) to smoke. Unfortunately, simply eliminating the chamber would also expose the sensing element of the sensor to high intensity ambient light, which would flood the sensing element and prevent the sensor from detecting smoke.

BRIEF SUMMARY

In one embodiment, a method for detecting smoke via a chamber-less smoke sensor includes applying one or more filters to eliminate a flooding of ambient light upon the smoke sensor and emitting, by a source, light. At least one detector detects at least a portion of the emitted light and a processor processes the detected light to signal an alarm condition when one or more threshold levels are reached.

Additionally or alternatively, in this or other embodiments the emitted light includes a plurality of different wavelengths.

Additionally or alternatively, in this or other embodiments a first of the wavelengths includes a first wavelength in the optical spectrum, and wherein a second of the wavelengths includes a second wavelength in the optical spectrum.

Additionally or alternatively, in this or other embodiments the detected light includes the emitted light obscured by one or more particles located in the smoke sensor, and wherein the threshold level is based on a difference in the detected light as a function of the plurality of different wavelengths.

Additionally or alternatively, in this or other embodiments the detected light includes scattered light that is scattered by one or more particles located in the smoke sensor, and wherein the threshold levels are based on a difference or a ratio of scattered light associated with a first of the wavelengths and scattered light associated with a second of the wavelengths.

Additionally or alternatively, in this or other embodiments the processing of the detected light includes obtaining a distribution of the one or more particles in terms of the size of the one or more particles.

Additionally or alternatively, in this or other embodiments an offset adjustment is provided to account for a sensitivity of the at least one detector to light of the different wavelengths.

Additionally or alternatively, in this or other embodiments a first filter is coupled to the source to obtain a reference electrical field orientation for at least one field associated with the light emitted by the source. A second filter is coupled to at least one detector to detect change in a distribution of electrical field orientations of the at least one field relative to the reference electrical field orientation.

Additionally or alternatively, in this or other embodiments a mechanical baffle is coupled to the at least one detector to prevent stray light within the smoke sensor from reaching at least one detector.

In another embodiment, a chamber-less smoke sensor includes a light source configured to emit light and at least one detector configured to detect at least a portion of the emitted light. An electronic filter and/or a processor is configured to apply one or more filters to eliminate a flooding of ambient light upon the smoke sensor and process the detected light to signal an alarm condition when a threshold level is reached.

Additionally or alternatively, in this or other embodiments the emitted light includes a plurality of different wavelengths.

Additionally or alternatively, in this or other embodiments a first of the wavelengths includes a first wavelength in the optical spectrum, and wherein a second of the wavelengths includes a second wavelength in the optical spectrum.

Additionally or alternatively, in this or other embodiments the detected light includes the emitted light obscured by one or more particles located in the smoke sensor, and wherein the threshold levels are based on a difference in the detected light as a function of the plurality of different wavelengths.

Additionally or alternatively, in this or other embodiments the detected light includes scattered light that is scattered by one or more particles located in the smoke sensor, and wherein the threshold level is based on a difference or a ratio of scattered light associated with a first of the wavelengths and scattered light associated with a second of the wavelengths.

Additionally or alternatively, in this or other embodiments the processor is configured to obtain a distribution of the one or more particles in terms of the size of the one or more particles based on the processing of the detected light.

Additionally or alternatively, in this or other embodiments the processor is configured to provide an offset adjustment to account for a sensitivity of at least one detector to light of the different wavelengths.

Additionally or alternatively, in this or other embodiments a first polarizer is coupled to the source, wherein the first polarizer is configured to obtain a reference electrical field orientation for at least one field associated with the light emitted by the source. A second polarizer is coupled to the at least one detector, wherein the second polarizer and the at least one detector are configured to detect a change in a distribution of orientations of the at least one electrical field relative to the reference orientation. The threshold level is based on the distribution of electrical field orientations.

Additionally or alternatively, in this or other embodiments a mechanical baffle is coupled to the at least one detector to prevent stray light within the smoke sensor from reaching the at least one detector.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
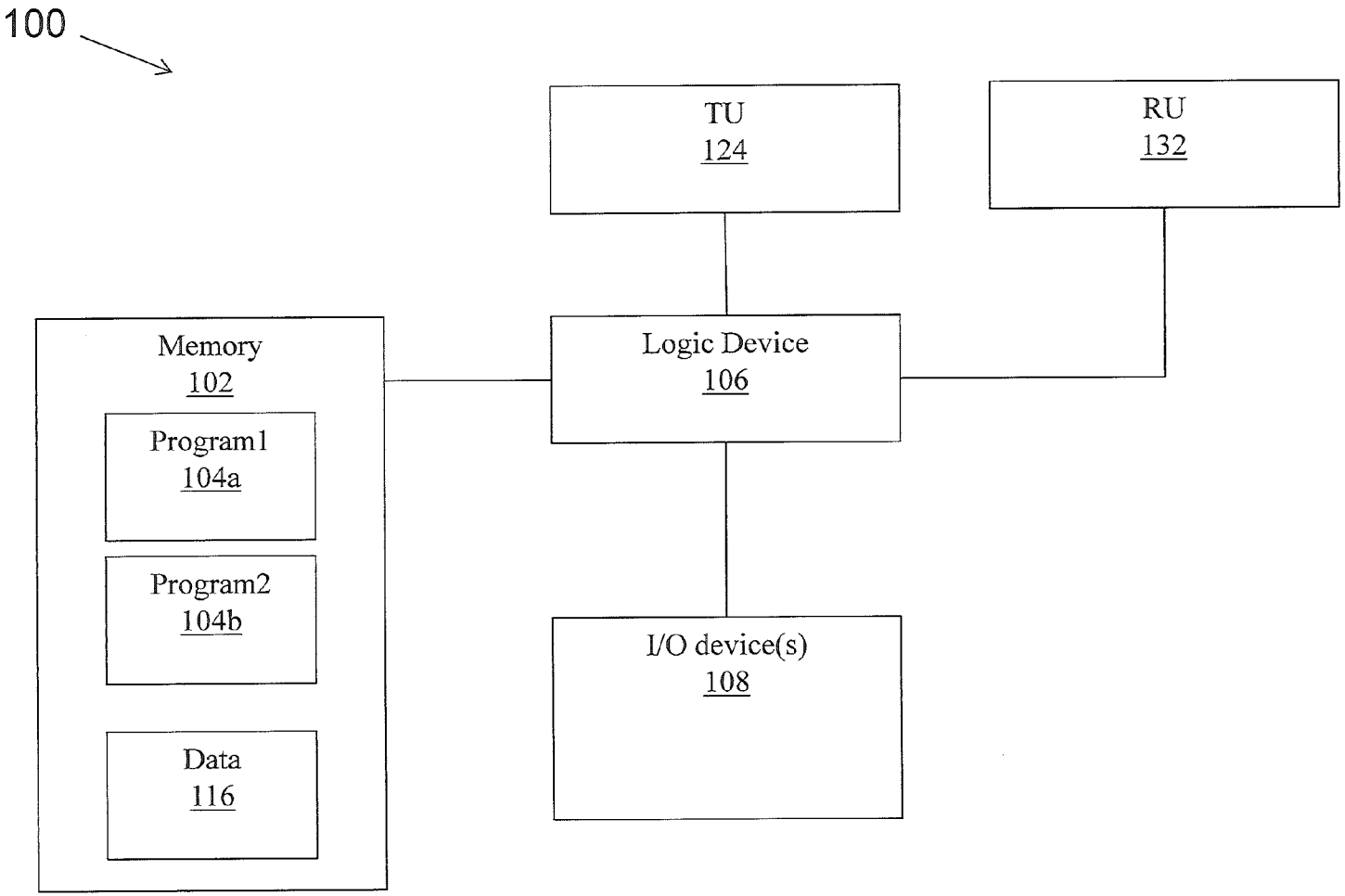
FIG. 1 is a diagram illustrating an exemplary computing system.

It is noted that various connections are set forth between elements in the following description and in the drawings (the contents of which are included in this disclosure by way of reference). It is noted that these connections in general may be direct or indirect and that this specification is not intended to be limiting in this respect. In this respect, a coupling between entities may refer to either a direct or an indirect connection.

Exemplary embodiments of apparatuses, systems, and methods are described for providing a smoke sensor. The smoke sensor does not include a chamber, but may be located in an enclosure or an alarm, thereby eliminating the risk for clogged chamber inlets and reducing the likelihood of nuisance faults or false positives (e.g., signaling an alarm condition when in fact no such alarm condition is actually present). The sensor may use multiple wavelength light scattering and/or multiple wavelength obscuration as part of a detection technique. In some embodiments, one or more algorithms may be used to enhance smoke sensor selectivity relative to other airborne particles and bugs/insects.

In some embodiments, a sensor may include electronic filters and/or algorithms (e.g., filters implemented in software) to assist the sensor in discriminating between ambient light modulation and real smoke induced signals. Signals caused by ambient light may be rejected by filtration techniques. Signals caused by smoke scattering or obscuration may be accepted or passed. Measured signals, such as those signals due to scattering and obscuration, may be conditioned and processed and may be used to make alarm decisions after preset threshold levels are reached.

Turning now to FIG. 1, a system 100 in accordance with one or more embodiments is shown. The system 100 may be associated with a sensor, such as a smoke sensor.

The system 100 is shown as including a memory 102. The memory 102 may store executable instructions. The executable instructions may be stored or organized in any manner and at any level of abstraction, such as in connection with one or more applications, processes, routines, methods, etc. As an example, at least a portion of the instructions are shown in FIG. 1 as being associated with a first program 104*a* and a second program 104*b*.

The instructions stored in the memory 102 may be executed by one or more logic devices 106, e.g., a processor, a programmable logic device (PLD) a field programmable gate array (FPGA), etc.

In terms of the use of the logic devices 106, in some embodiments the logic devices 106 may be organized or arranged as a pipeline. For example, in some instances it may be desirable to have an overall time resolution of 1 nanosecond, corresponding to a sampling frequency of 1 GHz. In order to use a low-cost FPGA with a time resolution of 8 nanoseconds, eight such samplers may be arranged in a pipeline, where each may perform a portion (e.g., one-eighth) of the overall work. The metrics provided are illustrative, and any time resolution or number of devices, samplers, or FPGAs may be used in a given embodiment.

The logic device 106 may be coupled to one or more input/output (I/O) devices 108. In some embodiments, the I/O device(s) 108 may include one or more of a keyboard or keypad, a touchscreen or touch panel, a display device, a microphone, a speaker, a mouse, a button, a remote control, a joystick, a printer, a fire panel, etc. The I/O device(s) 108 may be configured to provide an interface to allow a user to interact with the system 100.

The memory 102 may store data 116. The data 116 may be based on an emission or reception of one or more signals. For example, the system 100 may include an emitter or transmission unit (TU) 124 that may emit or transmit one or more signals and a reception unit (RU) 132 that may receive one or more signals. The data 116 may be indicative of an environment in which the system 100 is located. The data 116 may be processed by the logic device 106 to determine the existence or location of smoke within an area being monitored by the system 100.

The system 100 is illustrative. In some embodiments, one or more of the entities may be optional. In some embodiments, additional entities not shown may be included. For example, in some embodiments the system 100 may be associated with one or more networks. In some embodiments, the entities may be arranged or organized in a manner different from what is shown in FIG. 1.

Figure 2:
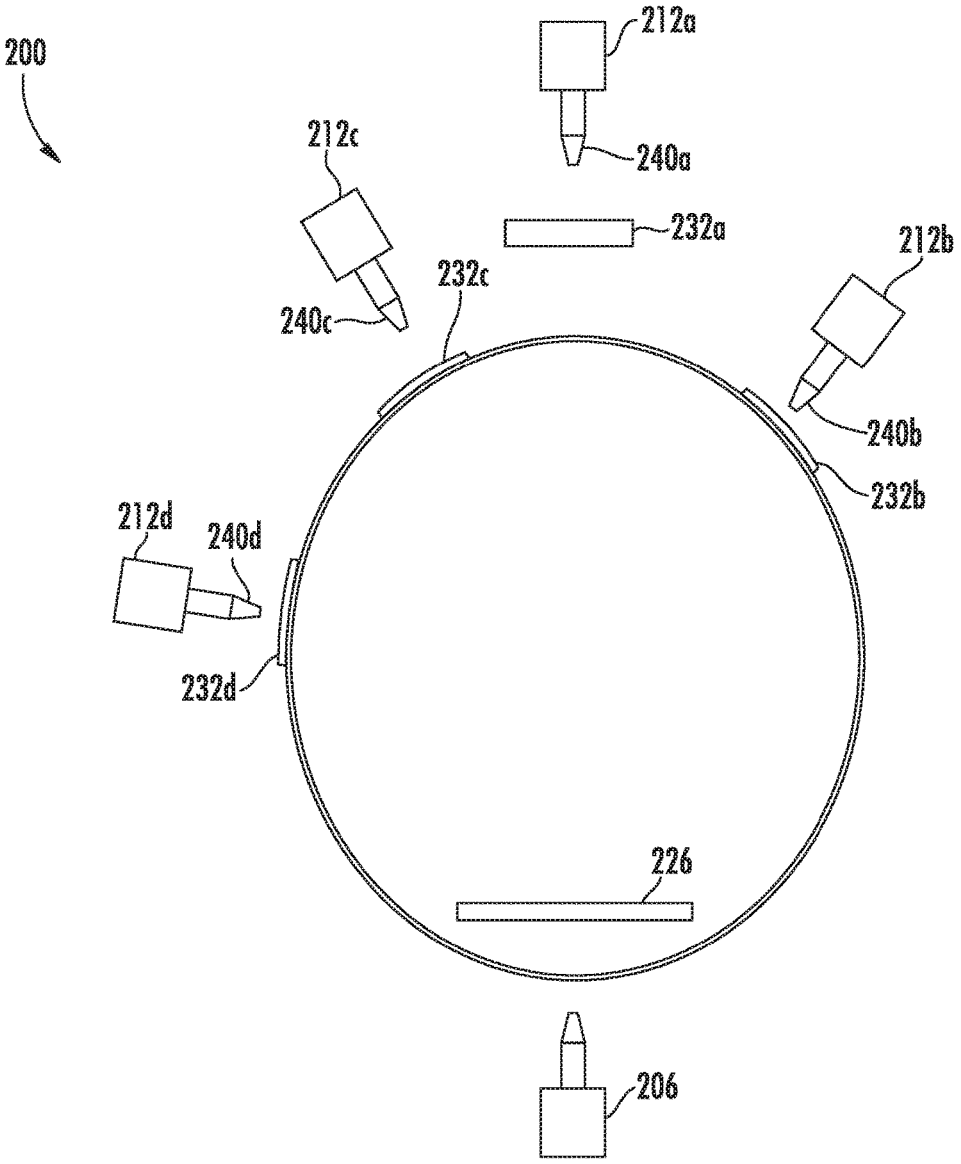
FIG. 2 is a diagram illustrating an exemplary smoke sensor.

Referring to FIG. 2, a sensor 200 is shown. The sensor 200 includes a light source 206. The light source 206 may include a light emitting diode (LED). The light source 206 may emit light at one or more wavelengths. For example, the light source 206 may emit light of wavelengths characteristic of red and blue visible light in an embodiment.

The sensor 200 may include one or more detectors, such as detectors 212*a*, 212*b*, 212*c*, and 212*d*. The detector 212*a* may substantially be located within a direct line of sight of light emitted by the light source 206. The detectors 212*b*, 212*c*, and 212*d* may be located at an angle with respect to an axis associated with the line of sight. For example, as shown in FIG. 2, detector 212*b* is at an angle of 50 degrees, detector 212*c* is at an angle of 30 degrees, and detector 212*d* is at an angle of 70 degrees. Other values or angles may be used in some embodiments.

When no particles have infiltrated the sensor 200, the light emitted by the light source 206 may proceed to the detector 212*a* in an unobstructed manner or fashion. Conversely, when an intervening particle (e.g., a particle due to smoke) is present between the light source and the detector 212*a*, at least a portion of the light emitted by the light source 206 may be obscured (e.g., reflected, scattered or absorbed) by the particle.

Absorption characteristics may be leveraged in connection with the obscuration mode of operation described above to determine if a smoke particle is present in the sensor 200, or more specifically, to distinguish between a smoke particle and another particle (e.g., a particle due to dust or steam). For example, a smoke particle may demonstrate different absorption qualities or characteristics at different wavelengths, whereas a dust or steam particle may generally be insensitive to the wavelength that is used in terms of absorption. Accordingly, if the light source 206 is configured to emit at least two pulses of light in a short amount of time that are differentiated from one another in terms of wavelength (or analogously, frequency), and if the signal output from the detector 212*a* indicates a change in an amount greater than a threshold from the first pulse to the second pulse, that may serve as an indication that a smoke particle is likely present. On the other hand, if the signal output from the detector 212*a* indicates a change or difference that is less than the threshold from the first pulse to the second pulse, that may serve as an indication that a smoke particle is likely not present.

The detectors 212*b*, 212*c*, and 212*d* may be used in connection with a scattering mode of operation. The scattering mode of operation may be based on a deflection or deviation of light from the straight-line path between the light source 206 and the detector 212*a* due to the presence of one or more particles in the path. The efficiency of the scattering may be a function of the wavelength of the light emitted by the light source. Accordingly, if the light source 206 is configured to emit at least two pulses of light of different wavelengths, such as in the manner described above in connection with the obscuration mode of operation, taking a ratio of: (1) scattered light detected by the detectors 212*b*, 212*c*, and 212*d* for the first pulse, and (2) scattered light detected by the detectors 212*b*, 212*c*, and 212*d* for the second pulse may provide information or data that is indicative of the distribution of (the sizes of) particles located within the sensor 200. The distribution of the particles may be analyzed to determine the likely origin or cause of the particles (e.g., smoke, dust, steam, cooking, etc.) in the sensor 200.

In terms of the use of multiple wavelengths by the sensor 200, additional techniques may be used to enhance the smoke detection. For example, the sensor 200 may be subjected to a calibration or offset adjustment to eliminate any variation in the output of the detectors 212*a*-212*d* in terms of detector sensitivity to light of differing wavelengths. The calibration or offset adjustment may take the form:

$$X=(\text{alpha}*\text{wave}_1)-(\text{beta}*\text{wave}_2), \text{ where}$$

$\text{wave}_1$ and $\text{wave}_2$ may be indicative of the wavelength of the first and second pulses, respectively, and alpha and beta may be indicative of coefficients or weights applied to the wavelengths of the first and second pulses. The values of alpha and beta may be selected so that 'X' is equal to zero when (substantially) no particles are present in the sensor 200.

Once the offset adjustment has been provided, the presence of particles in the sensor 200 may cause a distribution in the value of 'X' to be obtained. The sign of 'X' may serve as an indication of whether smoke is present. For example, if smoke particles are present then 'X' may generally have positive values and if smoke particles are not present then 'X' may generally have negative values.

In some embodiments, the sensor 200 may include one or more filters of polarizers configured to perform polarization. For example, a polarizer 226 may be associated with the light source 206. A polarizer 232*a* may be associated with the detector 212*a*. A polarizer 232*b* may be associated with the detector 212*b*. A polarizer 232*c* may be associated with the detector 212*c*. A polarizer 232*d* may be associated with the detector 212*d*. In some instances, the polarizers 232*a*-232*d* may be referred to as analyzers.

The polarizer 226 may be used to provide a reference or initial orientation or angle (e.g., 0 degrees) to one or more fields (e.g., an electric field) associated with the signal emitted from the light source 206. If particles are present in the sensor 200 that are not due to smoke, such as particles caused by steam or dust, then the particles may subject the field(s) to a random distribution in terms of any transformation of the initial orientation. If smoke particles (e.g., charged smoke particles) are present in the sensor 200, when the field(s) encounter the smoke particles, the field(s) may undergo a transformation or re-orientation to a particular angle (e.g., 65 degrees), or a small subset of angles within a larger distribution of angles. One or more of the polarizers/analyzers 232*a*-232*d* may be used to facilitate detecting a change in the distribution of orientation/angle by passing those orientations/angles indicative of smoke and rejecting others. In this manner, the polarizers 226 and 232*a*-232*d* may effectively implement a filter.

In some embodiments, the sensor may include one or more baffles, such as baffles 240*a*, 240*b*, 240*c*, and 240*d*. Baffle 240*a* may be associated with detector 212*a*. Baffle 240*b* may be associated with detector 212*b*. Baffle 240*c* may be associated with detector 212*c*. Baffle 240*d* may be associated with detector 212*d*. The baffles 240*a*-240*d* may include mechanical baffles. The baffles 240*a*-240*d* may prevent any stray light that may be caused by, e.g., reflection or scattering within the sensor 200 from reaching the detectors 212*a*-212*d*, respectively. The inclusion of the baffles 240*a*-240*d* may allow for the use of a light source 206 with a large viewing or emission angle, which can be used to minimize the cost of the light source 206. Further, in some embodiments a baffle 240 may be positioned at light source 206 to reduce reflections from other components onto the printed circuit board, and/or to reduce an amount of stray light emitted from the light source 206 during its operation.

The sensor 200 is illustrative. In some embodiments, one or more of the entities may be optional. In some embodiments, additional entities not shown may be included. In some embodiments, the entities may be arranged or organized in a manner different from what is shown in FIG. 2.

In some embodiments, one or more of the entities described above in connection with the system 100 and/or the sensor 200 may be included on one or more printed circuit boards or assemblies.

Figure 3:
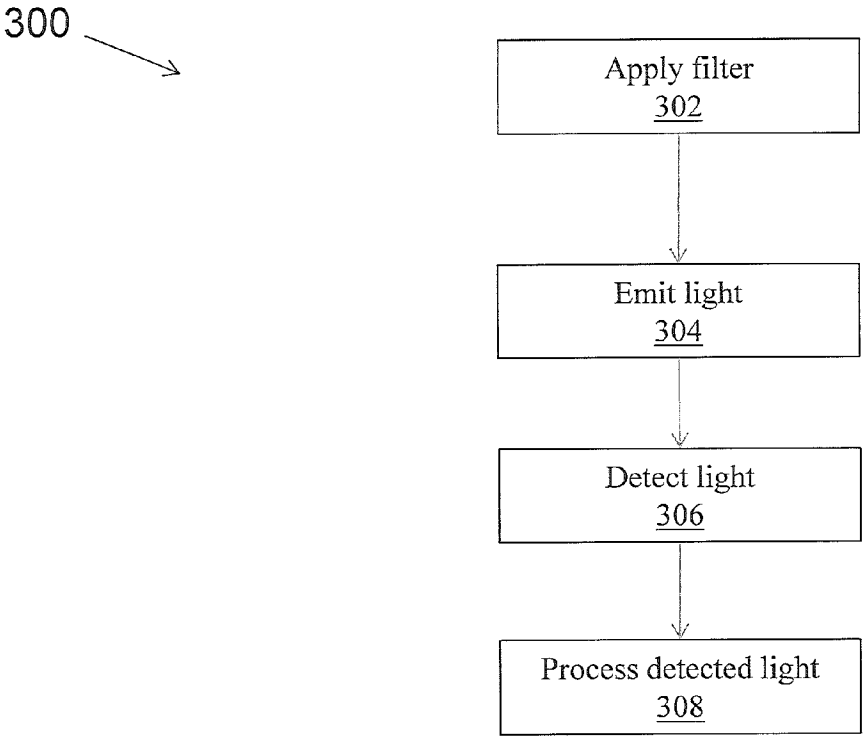
FIG. 3 illustrates a flow chart of an exemplary method.

Turning now to FIG. 3, a flow chart of a method 300 is shown. The method 300 may be operative in connection with one or more environments, systems, devices, or components, such as those described herein. For example, the method 300 may be applied in connection with a chamberless smoke sensor. The method 300 may be used to determine the existence, or likelihood of the existence, of smoke or fire in an area that is being monitored.

In block 302, one or more filters may be applied. For example, a hardware filter and/or filter algorithm (potentially implemented via firmware or software) may be applied to eliminate or reduce the effect of ambient light incident upon a photoelectric sensor or detector. Application of the filter may be used to overcome "flooding" the smoke sensor with light.

In block 304, light may be emitted from a light source. The light may be emitted at multiple wavelengths, potentially in conjunction with one or more pulses.

In block 306, the light emitted as part of block 304 may be detected. The detection may occur in connection with an obscuration mode and/or a scattering mode of operation.

In block 308, the detected light may be conditioned and processed. As part of the processing of block 308, alarm decisions may be made after one or more threshold levels are reached.

In some embodiments, one or more of the blocks or operations (or a portion thereof) of the method 300 may be optional. In some embodiments, the blocks may execute in an order or sequence different from what is shown in FIG. 3. In some embodiments, one or more additional blocks or operations not shown may be included.

Embodiments of the disclosure may take advantage of a non-directional open design (e.g., no smoke chamber) and the use of spectral signatures of smoke (e.g., scattering, absorption, and obscuration) to enhance selectivity to smoke particles within a broad range of particle sizes (e.g., 30 nm to microns).

In some embodiments, an algorithm is used to discriminate between smoke and other airborne particles and insects. Spectral signals measured by optics of the sensor may serve as inputs to the algorithm. The algorithm uses linear functions of the spectral signals to define response ranges specific to smoke versus other types of particles. The chamber-less design increases the robustness of the sensor to dust collection, reduces its cost, and improves manufacturability. The sensor is less prone to nuisance and false alarm and is stable to a mechanical displacement of its optical components. Accordingly, a transition to mass production is easily facilitated.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors, and memory storing instructions that, when executed by the one or more processors, cause the apparatus or system to perform one or more methodological acts as described herein. Various mechanical components known to those of skill in the art may be used in some embodiments.

Embodiments may be implemented as one or more apparatuses, systems, and/or methods. In some embodiments, instructions may be stored on one or more computer-readable media, such as a transitory and/or non-transitory computer-readable medium. The instructions, when executed, may cause an entity (e.g., an apparatus or system) to perform one or more methodological acts as described herein.

Aspects of the disclosure have been described in terms of illustrative embodiments thereof Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. A method for detecting smoke via a chamber-less smoke sensor, comprising:

applying, one or more filters to eliminate a flooding of ambient light upon the smoke sensor;

emitting, by a source, light;

detecting, by at least one detector, at least a portion of the emitted light; and processing, by a processor, the detected light to signal an alarm condition when one or more threshold levels are reached;

wherein the emitted light comprises a plurality of different wavelengths; and wherein the detected light comprises the emitted light obscured by one or more particles located in the smoke sensor, and wherein the threshold level is based on a difference in the detected light as a function of the plurality of different wavelengths.

2. The method of claim 1, wherein a first of the wavelengths comprises a first wavelength in an optical spectrum, and wherein a second of the wavelengths comprises a second wavelength in the optical spectrum.

3. The method of claim 1, wherein the detected light comprises scattered light that is scattered by one or more particles located in the smoke sensor, and wherein the threshold levels are based on a difference or a ratio of scattered light associated with a first of the wavelengths and scattered light associated with a second of the wavelengths.

4. The method of claim 3, wherein the processing of the detected light comprises obtaining a distribution of the one or more particles in terms of a size of the one or more particles.

5. The method claim 1, further comprising:

providing an offset adjustment to account for a sensitivity of the at least one detector to light of the different wavelengths.

6. The method of claim 1, further comprising:

coupling a first filter to the source to obtain a reference electrical field orientation for at least one field associated with the light emitted by the source; and coupling a second filter to at least one detector to detect change in a distribution of electrical field orientations of the at least one field relative to the reference electrical field orientation.

7. The method of claim 1, further comprising:

coupling a mechanical baffle to the at least one detector to prevent stray light within the smoke sensor from reaching at least one detector.

8. A chamber-less smoke sensor comprising:

a light source configured to emit light;

at least one detector configured to detect at least a portion of the emitted light; and an electronic filter and/or a processor configured to:

apply one or more filters to eliminate a flooding of ambient light upon the smoke sensor; and process the detected light to signal an alarm condition when a threshold level is reached;

wherein the emitted light comprises a plurality of different wavelengths; and wherein the detected light comprises the emitted light obscured by one or more particles located in the smoke sensor, and wherein the threshold levels are based on a difference in the detected light as a function of the plurality of different wavelengths.

9. The smoke sensor of claim 8, wherein a first of the wavelengths comprises a first wavelength in an optical spectrum, and wherein a second of the wavelengths comprises a second wavelength in the optical spectrum.

10. The smoke sensor of claim 8, wherein the detected light comprises scattered light that is scattered by one or more particles located in the smoke sensor, and wherein the threshold level is based on a difference or a ratio of scattered light associated with a first of the wavelengths and scattered light associated with a second of the wavelengths.

11. The smoke sensor of claim 10, wherein the processor is configured to obtain a distribution of the one or more particles in terms of a size of the one or more particles based on the processing of the detected light.

12. The smoke sensor of claim 8, wherein the processor is configured to provide an offset adjustment to account for a sensitivity of at least one detector to light of the different wavelengths.

13. The smoke sensor of claim 8, further comprising:

a mechanical baffle coupled to the at least one detector to prevent stray light within the smoke sensor from reaching the at least one detector.

14. A smoke sensor, comprising:

a light source configured to emit light;

at least one detector configured to detect at least a portion of the emitted light;

an electronic filter and/or a processor configured to:

apply one or more filters to eliminate a flooding of ambient light upon the smoke sensor; and process the detected light to signal an alarm condition when a threshold level is reached;

a first polarizer coupled to the light source, wherein the first polarizer is configured to obtain a reference electrical field orientation for at least one field associated with the light emitted by the source; and a second polarizer coupled to the at least one detector, wherein the second polarizer and the at least one detector are configured to detect a change in a distribution of orientations of the at least one electrical field relative to the reference orientation, wherein the threshold level is based on the distribution of electrical field orientations.

* * * * *